US006696940B2

(12) United States Patent
Marino et al.

(10) Patent No.: US 6,696,940 B2
(45) Date of Patent: Feb. 24, 2004

(54) SYSTEM AND METHOD FOR LOOP DIAGNOSTICS IN A SECURITY SYSTEM

(75) Inventors: Francis C. Marino, Dix Hills, NY (US); Tony Tung Sing Li, Roslyn Heights, NY (US)

(73) Assignee: Honeywell International Inc., Morristown, NJ (US)

( * ) Notice: Subject to any disclaimer, the term of this patent is extended or adjusted under 35 U.S.C. 154(b) by 243 days.

(21) Appl. No.: 09/996,492

(22) Filed: Nov. 29, 2001

(65) Prior Publication Data

US 2003/0101352 A1 May 29, 2003

(51) Int. Cl.[7] ..... G08B 29/00

(52) U.S. Cl. ..... 340/511; 340/506; 340/508; 340/514; 340/286.02; 340/3.1; 307/10.1

(58) Field of Search ..... 340/506, 508, 340/514, 511, 533, 286.02, 3.1; 307/10.1

(56) References Cited

U.S. PATENT DOCUMENTS

| | | | | |
|---|---|---|---|---|
| 3,978,479 A | | 8/1976 | Schmitz | 340/502 |
| 4,412,211 A | | 10/1983 | Lautzenheiser et al. | 340/514 |
| 4,916,432 A | | 4/1990 | Tice et al. | 340/518 |
| 5,293,155 A | * | 3/1994 | Nicol et al. | 340/506 |
| 5,347,083 A | * | 9/1994 | Suzuki et al. | 84/613 |
| 5,432,529 A | * | 7/1995 | Azuhata | 345/100 |
| 5,990,571 A | * | 11/1999 | Sato et al. | 307/10.1 |
| 6,114,955 A | | 9/2000 | Brunius et al. | 340/539.24 |

* cited by examiner

*Primary Examiner*—Daryl Pope
(74) *Attorney, Agent, or Firm*—Anthony R. Barkume, PC

(57) ABSTRACT

A security system comprising a control panel and a plurality of individually-addressable security system modules connected to the control panel on a loop data bus. Each of the security system modules has a reference generating means for generating a variable reference voltage signal, which is controlled by control data received from the control panel. Each module also has means for selecting a loop input signal for analysis from a plurality of available loop input signals, and comparing means for comparing the selected loop input signal to the reference voltage signal. The comparing means generates an output signal when the selected loop input signal exceeds the reference voltage signal. The modules also have means for indicating to the control panel via the loop data bus the state of the reference generating means when the comparing means generates an output signal, whereby the control panel can determine the value of the selected loop input signal.

14 Claims, 4 Drawing Sheets

| Appended 16-Bit Configuration | | | | | | | | | | | | | | | | Input Voltage Level |
|---|---|---|---|---|---|---|---|---|---|---|---|---|---|---|---|---|
| 1 | 1 | 1 | 0 | 0 | 0 | 0 | 0 | 0 | 0 | 0 | 0 | 0 | 0 | 0 | 0 | **0.25VDD** |
| 1 | 1 | 1 | 1 | - | - | - | 0 | 0 | 0 | 0 | 0 | 0 | 0 | 0 | 0 | (0.3125-0.4375)VDD |
| 1 | 1 | 1 | 1 | 1 | 1 | 1 | 0 | 0 | 0 | 0 | 0 | 0 | 0 | 0 | 0 | **0.5VDD** |
| 1 | 1 | 1 | 1 | 1 | 1 | 1 | 1 | - | - | - | 0 | 0 | 0 | 0 | 0 | (0.5625-0.6875)VDD |
| 1 | 1 | 1 | 1 | 1 | 1 | 1 | 1 | 1 | 1 | 1 | 0 | 0 | 0 | 0 | 0 | **0.75VDD** |

FIG. 4

SYSTEM AND METHOD FOR LOOP DIAGNOSTICS IN A SECURITY SYSTEM

FIELD OF THE INVENTION

This invention relates to a method and system for implementing loop diagnostics in a polling loop security system.

BACKGROUND OF THE INVENTION

Security systems that comprise a number of devices, or modules, interconnected to a control panel by a communications bus, are well known in the art. Security modules typically are used to monitor an area of space or a specific access point, and report to the control panel if there is a change in status. For example, modules exist that monitor opening of doors or windows, that determine if an intruder has entered the premises such as by passive infrared surveillance techniques, or that determine if a fire has started, etc.

The modules used to monitor areas often utilize sealed or unsealed contacts which are either mechanically, magnetically, or electrically operated. These contacts are connected via electrical wire at distant positions from the control panel, which may be over thousands of feet in length. Both the resistance of the wire connections, including the resistance of the contacts themselves, can increase or decrease in time due to temperature, humidity, and general aging conditions.

A given contact is sometimes terminated with a fixed resistor which has a value that will allow the control to determine one of three states of the protected loop; normal, shorted, or opened. In this case, the shorted and opened conditions are abnormal conditions of alarm or trouble. Other contacts are monitored simply for its open or closed state. In either case, it is known that these protective loops can deteriorate with time and it would be of great advantage to the security system if the level of deterioration can be determined prior to that loop causing either a false alarm or false trouble condition.

SUMMARY OF THE INVENTION

The purpose of this invention is therefore to provide a diagnostic means of quantitatively determining the level of deterioration of the protective loops as employed in the subject polling loop security system utilizing diagnostic circuits employed in the system modules.

The present invention is therefore a security system comprising a control panel and a plurality of individually-addressable security system modules connected to the control panel on a loop data bus. Each of the security system modules has a reference generating means for generating a variable reference voltage signal, which is controlled by control data received from the control panel. Each module also has means for selecting a loop input signal for analysis from a plurality of available loop input signals, and comparing means for comparing the selected loop input signal to the reference voltage signal. The comparing means generates an output signal when the selected loop input signal exceeds the reference voltage signal. The modules also have means for indicating to the control panel via the loop data bus the state of the reference generating means when the comparing means generates an output signal, whereby the control panel can determine the value of the selected loop input signal.

The reference generating means includes a counter that has a clock input for incrementing the counter and a plurality of output bits. The clock input is configured to receive the control data from said control panel. There is also a digital-to-analog converter that has a plurality of input bits and an analog output for generating the variable reference voltage signal, wherein the input bits are coupled to the output bits of the counter. As a result, when the control data is a bit stream input to the counter, the counter will generate a reference voltage signal that increases as the number of clock pulses input to said counter increases.

The means for selecting a loop input signal for analysis from a plurality of available loop input signals includes a plurality of transistors, each of the transistors configured to switch a corresponding one of the loop input signals in accordance with a multiple-bit input selection command word received from said control panel.

The control panel transmits a serial control word including the input selection command word and the control data, wherein the control data is a plurality of serial clock pulses.

The means for indicating to the control panel via the loop data bus the state of the reference generating means when the comparing means generates an output signal includes means for suppressing the signal line comprising the serial clock pulses, whereby the control panel is able to determine the counter value at which the comparing means generates an output signal by analyzing the number of serial clock pulses that were sent to the module before the signal line comprising the serial clock pulses is suppressed.

The counter value may be used by the control panel to determine the relative voltage of the selected input with respect to a loop voltage applied to the module. The counter value may alternatively be used by the control panel to determine the actual voltage applied to the module by selecting a known reference voltage for measurement by the control.

BRIEF DESCRIPTION OF THE DRAWING

FIG. 4 is a table illustrating the measured voltages of the present invention.

DETAILED DESCRIPTION OF THE INVENTION

Figure 1:
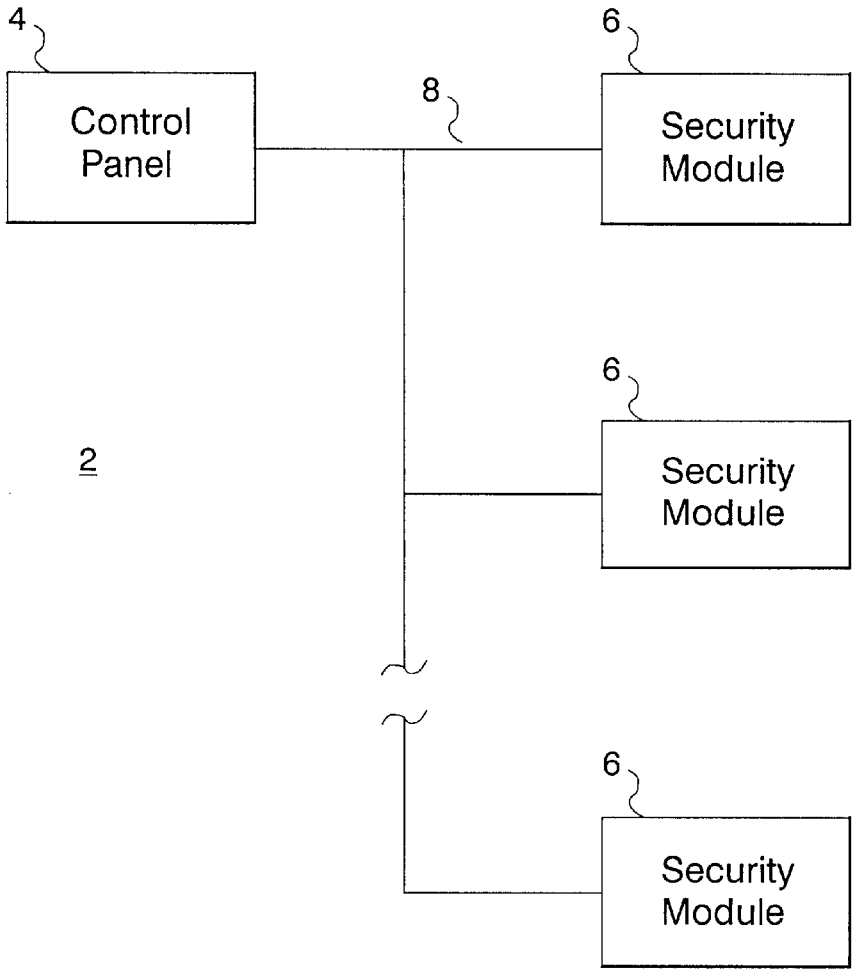
FIG. 1 is a block diagram of the present invention.
Figure 2:
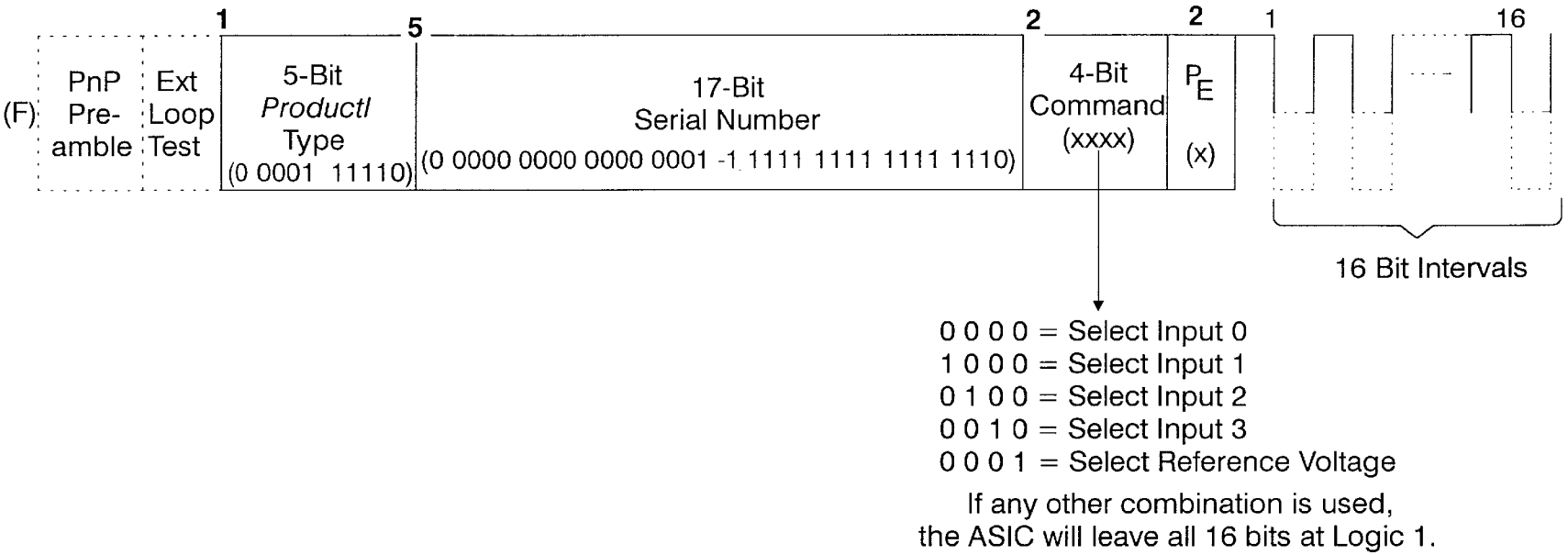
FIG. 2 illustrates the data format of a command word.

The preferred embodiment of the present invention will now be described. FIG. 1 illustrates a typical layout of a security system 2, which includes a control panel 4, a number of security modules 6, all of which are interconnected for data communications with the control panel 4 by a common data bus 8. The control panel 4 communicates with the modules 6 by means of a 37-bit serial data stream, which includes a preamble that defines the type of message being sent, and then various data fields that will vary as a function of the message being sent. FIG. 2 illustrates this data stream.

The security system modules 6 are multiple input/output devices. Specifically, there are 4 inputs and 2 outputs which are explained in detail below. The system employs a special polling format which provides an ability of the control to ascertain the input level of any of the 4 utilized protective loop inputs relative to the polling loop voltage applied to a specific module.

Figure 3:
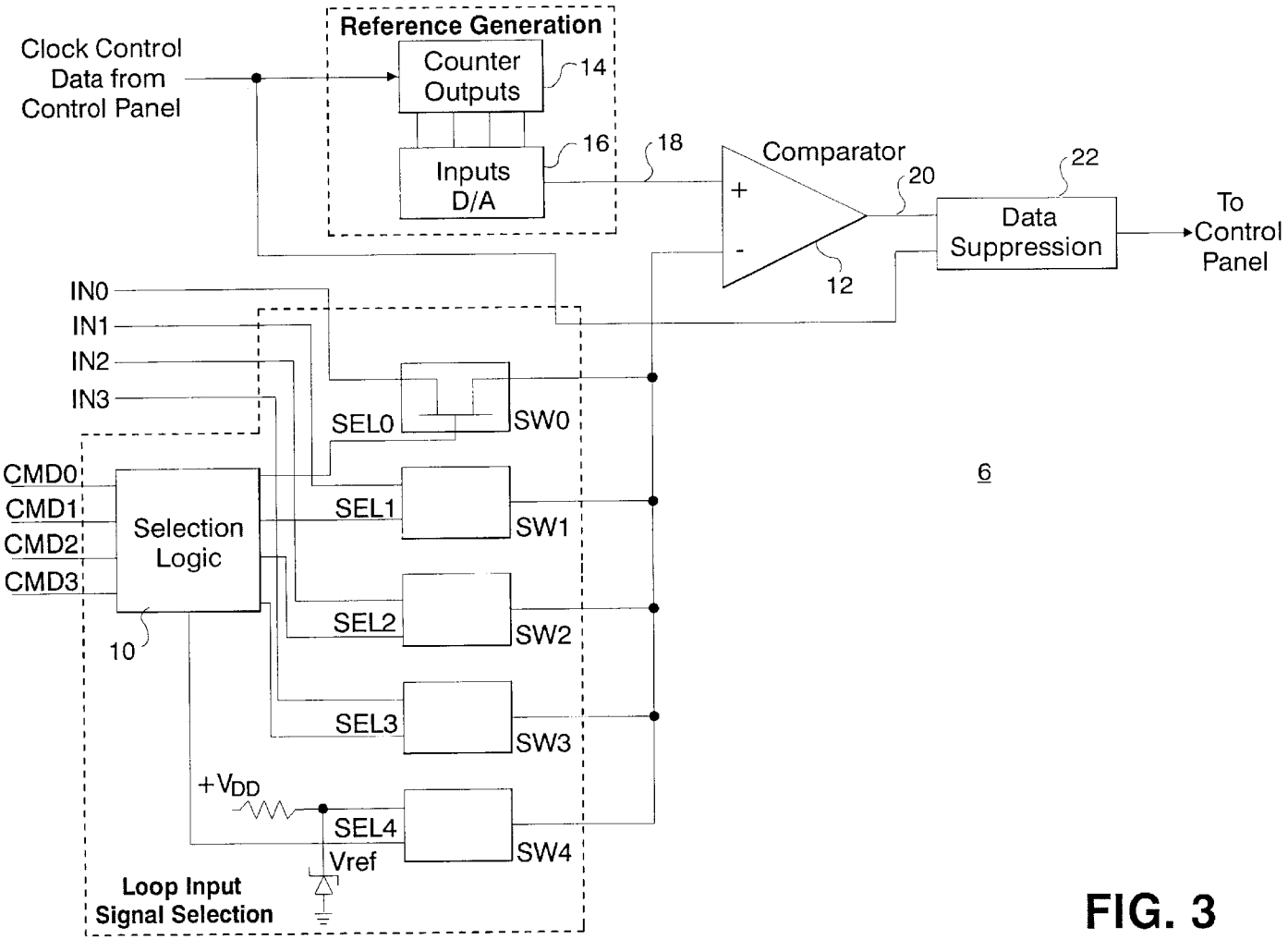
FIG. 3 is a schematic of the module circuitry that carries out the present invention.

The circuits employed to provide this facility are illustrated in FIG. 3. The circuit, which is embodied in the preferred embodiment in an application-specific integrated circuit (ASIC), consists of 4 electronic switches SW0, SW1, SW2, and SW3 (shown as field-effect transistors (FETs)) which are selectable by the control panel via a 4-bit command included in the polling loop format shown in FIG. 2. Each of the 4 bits, when made=logic 1, switches the corresponding protective loop input to the (–) input of the comparator circuit. Only one input can be selected by the panel per loop test poll.

Three of the four inputs (IN1–IN3) are bi-level inputs. That is, below 0.25VDD corresponds to logic 0, and above 0.75VDD corresponds to logic 1. All other levels between 0.25VDD and 0.75VDD are considered to be in the region of uncertainty and therefore are problematic. The fourth input, IN0, is a tri-level input used for supervising the state of the protective loop input. In this case, levels between 0.4VDD and 0.6VDD are considered normal wherein the input is neither open nor shorted. If the level is above 0.75VDD, the input is assumed open, whereas if the level is below 0.25VDD, the input is assumed shorted. There are two regions of uncertainty for this input as indicated in FIG. 4. The first region is between 0.6VDD and 0.75VDD, and the second region is between 0.25VDD and 0.4VDD. Either of these voltage level ranges are considered problematic for this input.

If the control panel is to examine IN0, for example, it sets the 4-bit command (CMD0, CMD1, CMD2, and CMD3) to 0000. These inputs are analyzed by selection logic 10, and will cause the IN0 input to be selected via SWO and its actual voltage applied to the (–) input of the comparator 12. Appended to this polling format are sixteen (16) logic 1 bit intervals issued by the control. These bit intervals serve two functions. First, they serve as a clock which is used to increment a 4-bit binary counter 14 at one increment per bit interval. The 4-bit binary output is applied to a Digital-to-Analog (D/A) circuit 16 which generates an output voltage of 1/16 (or 0.0625) of the applied ASIC voltage (VDD) per increment. Thus, the counter 14 and D/A circuit 16 act as a reference generator since they cooperate to generate a reference signal 18 that varies (increases) as a function of the control data (the clock) received from the control panel. If the selected IN0 voltage is, for example, 0.55VDD, the output of the D/A circuit 16 will exceed the IN0 voltage when the counter 14 reaches a count of nine (9) since this will translate into a voltage level of (9)(0.0625)=0.563VDD. The comparator 12 will then transfer its output 20 from low to high, causing the suppression circuits 22 to respond by changing the 9th-16th bit intervals to logic 0 levels. The control panel will read the appended 16 bit intervals as 1111111100000000. Other possible voltage levels of this input would be as shown in FIG. 4.

In another aspect of the invention, the actual voltage may be measured by the system. When the reference voltage, $V_{REF}$, is selected by the control instead of one of the four loop inputs, the actual voltage applied to the associated transponder is determined by the relation: VDD (actual)= $16V_{REF}/n$; where n=the number of logic 1 bits preceding the first of the string of logic 0 bits appended to this loop test poll. For example, if $V_{REF}$=3.0 v and if the first logic 0 bit starts at bit interval=5, then the actual VDD voltage is (16)(3)/5=9.6 volts. The appended bit pattern would be 1111000000000000.

What is claimed is:

1. A security system comprising:

a control panel;

a plurality of individually-addressable security system modules connected to the control panel on a loop data bus; each of said modules comprising:

reference generating means for generating an incrementally increasing reference voltage signal, said means being controlled by control data received from the control panel;

means for selecting a loop input signal for analysis from a plurality of available loop input signals;

comparing means for comparing the selected loop input signal to the reference voltage signal, said comparing means generating an output signal when the selected loop input signal is exceeded by the incrementally increasing reference voltage signal;

means for indicating to the control panel via the loop data bus the state of the reference generating means when the comparing means generates an output signal;

whereby the control panel can determine the value of the selected loop input signal.

2. The security system of claim 1 wherein said reference generating means comprises a counter comprising a clock input for incrementing said counter and a plurality of output bits, said clock input configured to receive said control data from said control panel;

a digital-to-analog converter comprising a plurality of input bits and an analog output for generating said variable reference voltage signal, said input bits coupled to said output bits of said counter;

whereby, when said control data comprises a bit stream input to said counter, said counter will generate a reference voltage signal that increases as the number of clock pulses input to said counter increases.

3. The security system of claim 2 wherein said means for selecting a loop input signal for analysis from a plurality of available loop input signals comprises a plurality of transistors, each of said transistors configured to switch a corresponding one of said loop input signals in accordance with a multiple-bit input selection command word received from said control panel.

4. The security system of claim 3 wherein said control panel transmits a serial control word comprising the input selection command word and the control data, wherein the control data comprises a plurality of serial clock pulses.

5. The security system of claim 4 wherein said means for indicating to the control panel via the loop data bus the state of the reference generating means when the comparing means generates an output signal comprises means for suppressing the signal line comprising said serial clock pulses;

whereby the control panel is able to determine the counter value at which the comparing means generates an output signal by analyzing the number of serial clock pulses that were sent to the module before the signal line comprising said serial clock pulses is suppressed.

6. The security system of claim 5 wherein the counter value is used by the control panel to determine the relative voltage of the selected input with respect to a loop voltage applied to the module.

7. The security system of claim 5 wherein the counter value is used by the control panel to determine the actual loop voltage applied to the module by selecting a known reference voltage for comparison to the loop vooltage by the control.

8. In a security system comprising a control panel and a plurality of individually-addressable security system modules connected to the control panel on a loop data bus; a method of testing the security system comprising the steps of:

transmitting control data from the control panel to an addressed one of said modules over the data bus;

generating at the addressed module an incrementally increasing reference voltage signal controlled by the control data received from the control panel;

selecting at the addressed module, as a function of the control data, a loop input signal for analysis from a plurality of available loop input signals;

comparing the selected loop input signal to the reference voltage signal;

generating an output signal when the selected loop input signal is exceeded by the incrementally increasing reference voltage signal;

indicating to the control panel via the loop data bus the state of the reference generating means when the output signal is generated;

whereby the control panel can determine the value of the selected loop input signal.

9. The method of claim 8 wherein said step of generating an incrementally increasing reference voltage signal comprises the steps of:

inputting said control data as a clock signal into a counter;

coupling output bits of the counter to corresponding input bits on a digital-to-analog converter;

generating a reference voltage signal from the output of the digital to analog converter that increases as the number of clock pulses input to said counter increases.

10. The method of claim 9 wherein said step of selecting a loop input signal for analysis from a plurality of available loop input signals comprises the step of controlling a plurality of transistors in accordance with a multiple-bit input selection command word received from said control panel, each of said transistors configured to switch a corresponding one of said loop input signals.

11. The method of claim 10 wherein said control panel transmits a serial control word comprising the input selection command word and the control data, wherein the control data comprises a plurality of serial clock pulses.

12. The method of claim 11 wherein said step of indicating to the control panel via the loop data bus the state of the reference generating means when the output signal is generated comprises the step of for suppressing the signal line comprising said serial clock pulses;

whereby the control panel is able to determine the counter value at which the comparing means generates an output signal by analyzing the number of serial clock pulses that were sent to the module before the signal line comprising said serial clock pulses is suppressed.

13. The method of claim 12 wherein the counter value is used by the control panel to determine the relative voltage of the selected input with respect to a loop voltage applied to the module.

14. The method of claim 12 wherein the counter value is used by the control panel to determine the actual loop voltage applied to the module by selecting a known reference voltage for comparison to the loop voltage by the control.

* * * * *